United States Patent [19]

Pearce et al.

[11] 3,974,964

[45] Aug. 17, 1976

[54] LIQUID ATOMIZING METHOD AND APPARATUS

[75] Inventors: Larry N. Pearce, Oak Park; C. Lyle Lacy, Galena; Arthur E. Neumann, Winnetka, all of Ill.

[73] Assignee: Cotton Incorporated, New York, N.Y.

[22] Filed: June 25, 1975

[21] Appl. No.: 590,117

Related U.S. Application Data

[62] Division of Ser. No. 495,925, Aug. 9, 1974, Pat. No. 3,917,167.

[52] U.S. Cl. ..... 239/11; 239/553.3; 239/596; 239/598; 239/600

[51] Int. Cl.[2] ..... B05B 1/06

[58] Field of Search ..... 239/1, 4, 11, 102, 390, 239/553.3, 567, 590.3, 596, 598, 600

[56] References Cited

UNITED STATES PATENTS

| | | | |
|---|---|---|---|
| 3,190,562 | 6/1965 | Atwood et al. | 239/596 X |
| 3,877,510 | 4/1975 | Tegtmeier et al. | 239/598 X |

*Primary Examiner*—Evon C. Blunk
*Assistant Examiner*—Michael Mar
*Attorney, Agent, or Firm*—Burns, Doane, Swecker & Mathis

[57] ABSTRACT

A liquid atomizing method and apparatus including a conduit member having an annular ring eccentrically mounted thereon such that a radial port in the ring is aligned with a radial aperture in the conduit member. A thin flexible orifice ribbon is intercalated between the ring and the conduit member. In one embodiment of the invention, a vibratory device is rigidly mounted upon the exterior surface of the conduit member and functions to induce the formation of uniform droplets within fluid flowing through apertures in the orifice ribbon. In another embodiment of the invention an elongate flexible orifice ribbon, having a plurality of spaced orifice zones, may be mounted upon an advancement mechanism to facilitate maintenance of a clean unobstructed set of apertures in communication with the conduit port. The atomizing apparatus is readily serviceable without special tools.

6 Claims, 7 Drawing Figures

LIQUID ATOMIZING METHOD AND APPARATUS

This is a division, of application Ser. No. 495,925, filed Aug. 9, 1974, now U.S. Pat. No. 3,917,167.

BACKGROUND OF THE INVENTION

This invention relates generally to a method and apparatus for atomizing a liquid. More specifically, this invention is concerned with an easily cleaned and/or serviced atomizing nozzle which finds particular utility with difficult-to-handle liquids and which is capable of atomizing the liquid into uniform droplet sizes.

The process of atomization is of noteworthy importance in several branches of engineering including the chemical industry for operations involving drying, evaporating and absorption, the coating industry wherein paint is applied by a spraying technique, the agriculture industry for crop stimulation and protection, etc. Atomizing of a liquid is typically accomplished by forcing the fluid under pressure through a nozzle into the atmosphere where the liquid contracts into droplets.

Nozzle designs may often assume the configuration of a cylindrical nozzle body which is covered at one end by a transversely extending orifice plate or disc. The disc is typically releasably affixed to the end of the nozzle body by a conventional threaded ring connector. An illustration of such a nozzle configuration is disclosed, inter alia, in Vehe et al. U.S. Pat. No. 3,679,137 issued July 25, 1972 and assigned to the assignee of the subject application. The disclosure of this Vehe et al. patent is hereby incorporated by reference as though set forth at length.

While nozzle configurations, such as disclosed in the Vehe et al. patent, have been utilized with at least a degree of acceptance in the past, room for significant improvement remains.

More particularly, conventional nozzle orifice discs are often fabricated from somewhat thick brass sheet stock for considerations of strength and corrosion resistance. Apertures within the disc are often accurately bored with a diameter of a few hundredths inch or less. Accordingly, conventional nozzle orifice discs are somewhat expensive to manufacture.

Moreover, in many instances a "fan" spray pattern is desired. Such a spray pattern may be effected by forming a circular nozzle disc with a disc shape configuration and boring one or more rows of radially extending apertures through the disc-shaped disc. Accurately boring radial apertures merely heightens the previously noted manufacturing intricacy and expense.

During an atomizing operation, fines suspended within the liquid medium being dispensed tend to clog the aperture or apertures in the disc. Operational clogging dictates "on the job/in the field" shutdowns for servicing. In this regard an operator would typically release pressure from the fluid being dispensed and remove the threaded attachment collar to free the orifice disc for manual inspection and cleaning. It will be appreciated by those skilled in the art that during the foregoing procedure liquid within the nozzle body will in all likelihood spew onto the hands and forearms of the operator. In some instances, this occurence is merely objectionable and disconcerting. In other instances, it becomes mandatory that an operator's hands are properly isolated from direct contact with the liquid being atomized. Examples of such liquids would include vehicles carrying indelible pigments or an agricultural control fluid which is highly toxic by inhalation and/or skin absorption. A specific example of the latter is paraquat, which is a generic name for a 1,1'-dimethyl-4-4'-bipyridinium salt. Paraquat is a yellow solid herbicide which is soluble in water and is highly toxic by skin absorption.

An associated difficulty may be occasioned if it is desired to alter a spray flow pattern. In this regard, the system is again typically shut down and the orifice disc is replaced with one having a more appropriate aperture pattern. In making such a changeover, operator contamination may again present a difficulty as outlined above.

Another significant concern in atomizing operations is the tendency of atomized fluids to contract into droplets of variant sizes. As an example, conventional spray nozzles which would be designed to produce droplets having a mean diameter of 150 microns will also typically generate droplets ranging in size from 1 to 2 microns up to 300 or 400 microns in diameter. While the foregoing range in droplet sizes may be acceptable in some applications, in many instances finer control of droplet size during atomization would be highly desirable.

In this latter connection in large scale agriculture, it has been found in dispensing herbicides and pesticides that fine droplet sizes tend to be blown or drift away from a desired zone of application while very large droplet sizes tend to coalesce and drip from leaf surfaces without producing a desired biological action. In a similar vein in the spray painting industry, very fine droplets tend to be drawn into an overhead exhaust system while very large droplets tend to form undesirable globules upon a coated surface.

In the past, at least one device has been found to provide significant potential with respect to controlling droplet size during an atomization process. In this connection, attention is re-invited to the previously identified Vehe et al. patent. In this Vehe et al. patent, a jet stream vibratory atomizing device is disclosed wherein a magnetostrictive shaft is mounted within the interior of a nozzle body and functions to induce vibrations within a liquid dispensed through an orifice plate to break a liquid into uniform droplet sizes downstream of the orifice plate.

While the Vehe et al. structure offers considerable potential with respect to accurately dispensing a liquid, room for significant improvement remains.

It has been found that placement of a magnetostrictive vibratory shaft within the interior of a nozzle body represents at least a potential sealing problem as well as providing an obstruction to the flow of fluid through the nozzle body. Additionally, it would be desirable to enhance droplet size formation and/or to minimize energy input while maintaining acceptably accurate droplet control.

The problems suggested in the preceding are not intended to be exclusive but rather are among many which may tend to reduce the effectiveness of prior art atomizing assemblies. Other noteworthy difficulties may also exist; however, those presented above should be sufficient to demonstrate that atomizing methods and apparatus appearing in the prior art have not been altogether completely satisfactory.

OBJECTS AND BRIEF SUMMARY OF THE INVENTION

Objects

Accordingly, it is a general object of the invention to provide a novel atomizing or spraying method and apparatus which obviates or minimizes problems of the type previously described.

It is a more particular object of the invention to provide a novel atomizing method and apparatus which facilitates servicing of the unit in an "on the job/in the field" environment.

It is a related object of the invention to provide a novel atomizing method and apparatus wherein servicing may be readily accomplished without requiring an operator to become contaminated with the liquid being dispensed through the assembly.

It is another object of the invention to provide a novel atomizing method and apparatus which facilitates adjustments to produce various fluid spray patterns.

It is yet another object of the invention to provide a novel atomizing method and apparatus which may be readily cleaned "in the field."

It is a further object of the invention to provide a novel atomizing method and apparatus which enhances the formation of uniform droplet sizes during an atomizing operation.

It is still a further object of the invention to provide a novel uniform droplet atomizing method and apparatus wherein a central liquid flow path through the apparatus is maintained in a substantially unobstructed condition to facilitate flow through the apparatus.

It is yet a further object of the invention to provide a novel uniform droplet atomizing method and apparatus which will maintain the advantageous characteristic of droplet size control while minimizing the power requirements necessary to accomplish the task.

It is yet still a further object of the invention to provide a uniform droplet atomizing method and apparatus which will be highly rugged yet concomitantly facilely and economically manufacturable.

BRIEF SUMMARY

A novel apparatus, according to a preferred embodiment of the invention, which is intended to accomplish at least some of the foregoing objects, includes a conduit having one end closed and the other end thereof in communication with fluid under pressure. A radial aperture is fashioned through the conduit generally at the closed end thereof. A vibratory device, such as a magnetostrictive apparatus, is rigidly connected to the exterior surface of the conduit for imparting high frequency oscillations to the conduit. A ring having a diameter greater than the diameter of the conduit is positioned about the conduit at the closed end thereof and is provided with a radial port operably alignable and dimensionally compatible with the radial aperture in the conduit. A thin, normally flat, flexible ribbon, having a plurality of orifices fashioned therethrough, is releasably intercalated between the exterior surface of the conduit and the interior surface of the ring in a posture extending across the radial aperture and port thereof, respectively. The ring is attached to the conduit such that edge portions of the orifice ribbon are secured between the interior surface of the ring and the exterior surface of the conduit. Oscillations from the vibratory unit are imparted through the conduit to the orifice ribbon which interacts with liquid flowing through the apertures to subdivide the liquid into fine uniformly sized droplets downstream of the orifice ribbon.

A method according to a preferred embodiment of the invention for atomizing a liquid stream into a multiplicity of liquid droplets includes the steps of fitting a thin, normally flat, flexible orifice ribbon across a radial aperture fashioned within a conduit which is in communication with a fluid to be dispensed under pressure. A ring having a diameter greater than the diameter of the conduit is fitted about the closed end of the conduit. The ring is provided with a radial port such that it may be operably aligned with the radial aperture extending through the conduit. The next step entails releasably securing the ring to the conduit wherein edge portions of the orifice ribbon are secured between the interior surface of the ring and the exterior surface of the conduit. When it is desired to produce liquid droplets of uniform size, the conduit is vibrated by a vibratory mechanism rigidly connected to the exterior surface thereof to impart oscillations in the fluid flowing through the conduit which in turn induces the liquid to divide into uniform droplet sizes downstream of the orifice ribbon.

BRIEF DESCRIPTION OF THE DRAWINGS

These and many other objects and advantages of the invention will become apparent to one skilled in the art when the appended claims are read in conjunction with the detailed description of the invention and the illustrative drawings appended hereto.

Like reference numerals have been applied to like parts in the drawings where.

DETAILED DESCRIPTION OF PREFERRED EMBODIMENTS OF THE INVENTION

Context of the Invention

Prior to discussing in detail preferred embodiments of the subject atomizing method and apparatus it may be useful to briefly note at least one operative context where the invention finds particular utility.

Figure 1:
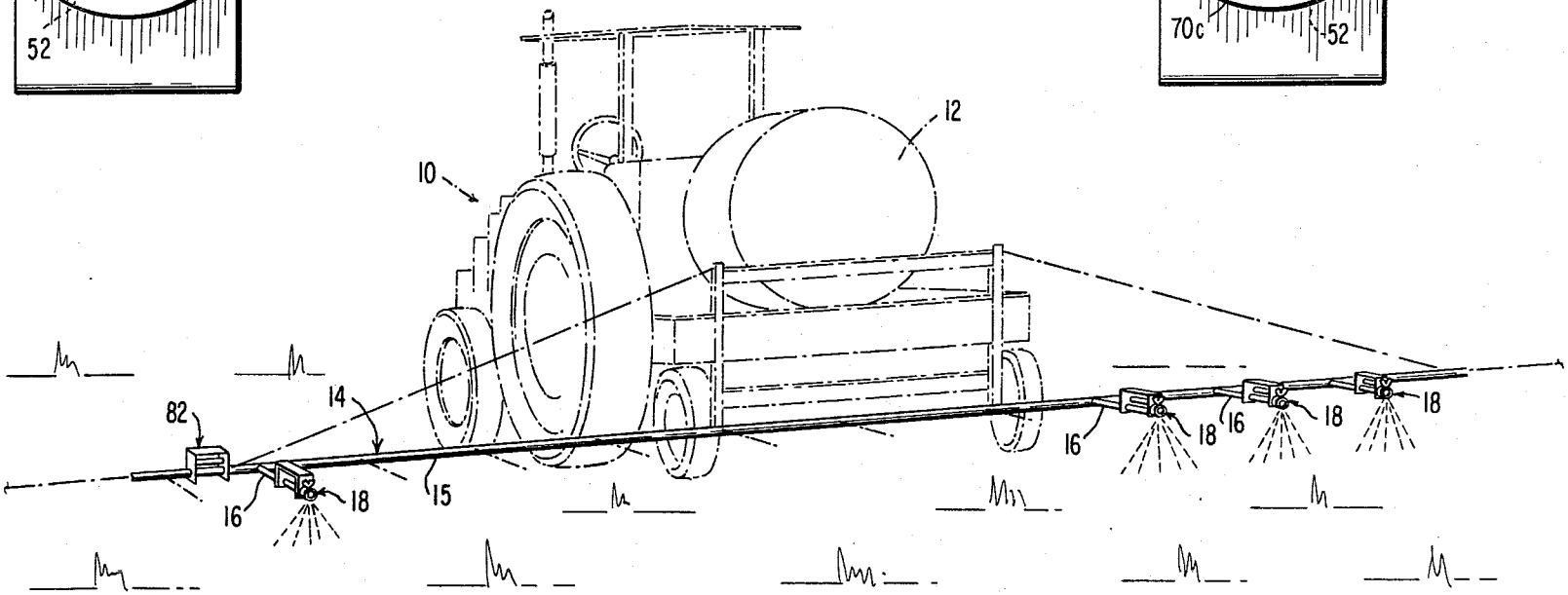
FIG. 1 is an axonometric view of a tractor and boom spray assembly utilizing nozzles designed in accord with the subject invention.
Figure 2:
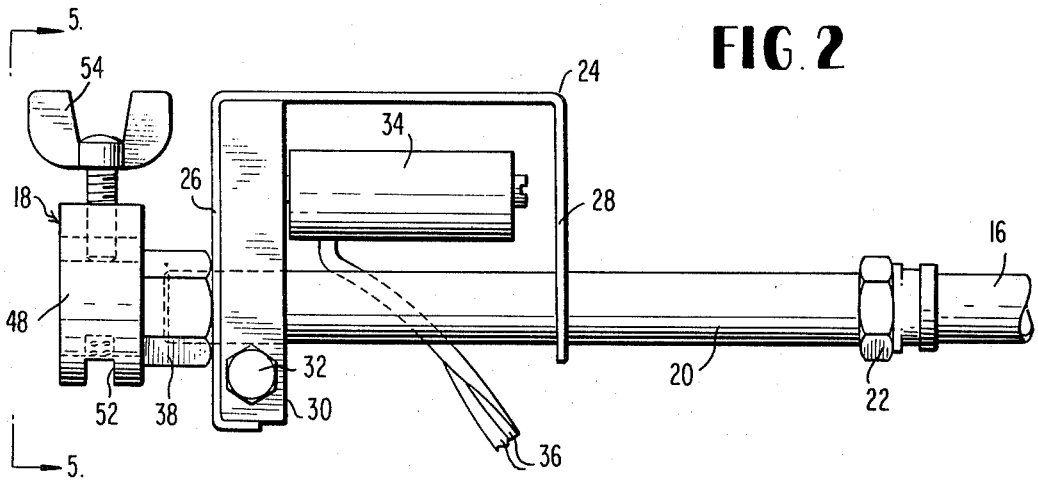
FIG. 2 is a side elevational detail view of a nozzle assembly according to a preferred embodiment of the invention.

Depicted in FIG. 1 is a typical agricultural type tractor 10 fitted with a broadcast spraying rig including a tank 12 for containing a liquid biological control agent and a horizontal spray boom 14 connected aft of the tank 12.

The spray boom 14 comprises a hollow pipe 15, or other suitable conduit, and preferably has a length substantially exceeding the lateral width of the tractor 10. A plurality of short hollow branch conduits 16 extend rearwardly at regular intervals spaced longitudinally along the pipe 15. Preferably the branch conduits 16 are coplanar and generally perpendicular to a longitudinal axis of the pipe 15. Each branch conduit conveys liquid from the pipe 15 to a nozzle assembly 18 at the terminal end of the branch conduit where the liquid is atomized.

Nozzle Assembly

Referring now specifically to FIGS. 2–5, the nozzle assembly 18 is shown in greater detail and includes a conduit member 20 suitably connected, such as by threaded connector 22, to the terminal end of the branch conduit 16. The conduit member 20 may comprise a short length of pipe having a diameter similar to that of the branch conduit 16.

The conduit member 20 carries a generally U-shaped exciter guard 24 having two arms 26, 28 and a clamp 30. The conduit 20 is received through suitable openings in the arms 26, 28 and is rigidly yet releasably engaged by the clamp 30. The exciter guard 24 is securely connected and positioned with respect to the conduit member 20 by connection with the clamp 30.

Figure 3:
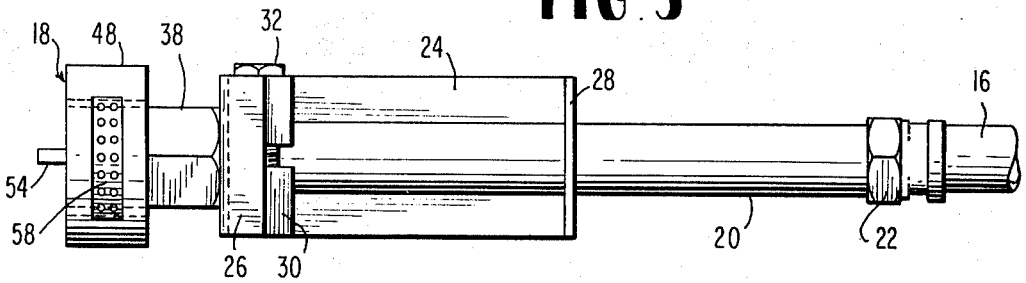
FIG. 3 is a bottom view of the nozzle assembly of FIG. 2.

The clamp 30 includes a pair of legs 31 and a transverse bolt 32 which is tightened to draw the legs 31 together for engagement with the conduit member 30 (see FIG. 3). The bolt 32, or other suitable releasable connection means, facilitates orientation of the clamp 30 and the U-shaped bracket 24 with respect to the conduit member 20.

Returning to FIG. 2, the clamp 30 receives one end of a magnetostrictive exciting member 34 which is electrically connected by means of electrical conductors 36 to a suitable source of high frequency electrical current carried by the tractor 10.

Figure 4:
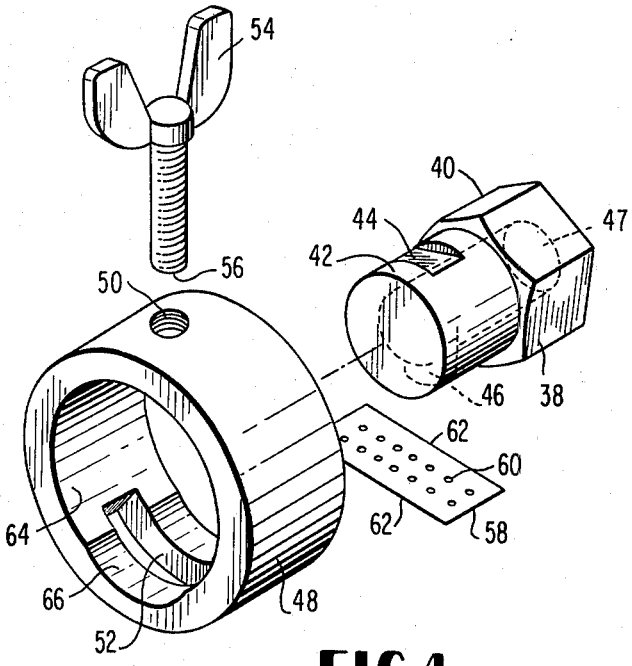
FIG. 4 is an exploded view of the nozzle head assembly of FIG. 2.

Remote from the threaded connector 22, the conduit 20 is provided with an externally threaded end which receives an internally threaded end of a nozzle body 38. As best illustrated by FIG. 4, the nozzle body 38 includes a generally hexagonal portion 40 and a generally cylindrical portion 42. The hexagonal portion 40 facilitates connection and positioning of the nozzle body 38 with respect to the conduit 20.

The cylindrical portion 42 includes a flat area 44 and a radial bore 46 which perpendicularly intersects a blind longitudinal bore 47 of the nozzle body 38. The radial bore 46 and the flat area 44 and preferably diametrically opposed. Ideally, the radial bore 46 and the longitudinal bore 47 have the same total flow area to minimize restriction of fluid flowing therethrough. In addition, nozzle body 38 should be arranged on the conduit member 20 such that the radial bore 46 is perpendicular to the longitudinal axis of the magnetostrictive device 34.

Figure 5:
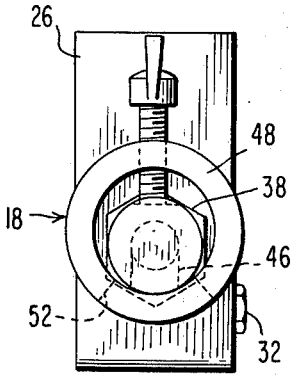
FIG. 5 is an end view of the nozzle assembly of FIG. 2 as viewed along line 5—5 of FIG. 2.

With reference now to FIG. 5, a generally annular ring member 48 is illustrated in an eccentric posture with respect to the cylindrical portion 42 of the nozzle body 38. In FIG. 4 the annular ring 48 is illustrated as having a threaded radial bore 50 and a generally rectangular radial arcuate opening 52 diametrically opposed to the threaded bore 50. The radial opening preferably has an included angle of 60° to 80° measured from the axis of the annular ring 48. The radial opening 52 is generally radially alignable with the radial bore 46 of the nozzle body 38 when the annular ring 48 is operably mounted upon the nozzle body 38.

To secure the annular ring 48 to the cylindrical portion 42 a wing bolt 54 is provided. The wing bolt 54 preferably includes a generally flat end 56 which abuts against the flat area 44 of the cylindrical portion 42 when the annular ring 48 is properly positioned with respect to the nozzle body 38.

Also illustrated in FIG. 4 is a thin normally flat, flexible orifice ribbon 58, or band, which includes two generally parallel rows of uniformly-sized apertures 60. The orifice ribbon 58 is preferably fabricated from a thin, flat, flexible resilient material which facilitates its manufacture and allows it to conform with the arcuate surface of cylindrical portion 42. An example of at least one such material is relatively thin stainless steel.

The orifice plate 58 is positioned within the annular ring 48 such that the longitudinal edges 62 of the orifice plate 58 are generally parallel with the circumferentially oriented edges of the radial opening 52. Accordingly, when the wing bolt 54 is tightened into engagement with the flat area 44 of the nozzle body 38, the orifice plate 58 is securely held in engagement between the cylindrical portion 42 of the nozzle body 38 and the internal surface 64 of the annular ring 48.

With the orifice plate 58 properly positioned in the nozzle assembly 18, FIG. 3 illustrates the nozzle assembly 18 in a configuration ready for use.

In order to obtain a better fluid seal between the annular ring 48, the nozzle plate 58, and the cylindrical portion 42, the internal ring surface 64 may be undercut as most clearly illustrated by FIG. 4. The surface curvature of the undercut portion 66 preferably conforms to the curvature of the nozzle body cylindrical portion 42. Alternatively, the cylindrical portion 42 may be fashioned with a radius of curvature, about the aperture 46, equal to the radius of curvature of the ring 48.

It will be apparent to those skilled in the art that it may be advantageous to provide a recess along the internal ring surface 64 to accommodate the orifice ribbon 58. Such a recess would necessarily have a width slightly greater than the lateral width of orifice ribbon 58 and would have a depth which is slightly less than the thickness of ribbon 58.

Figure 6:
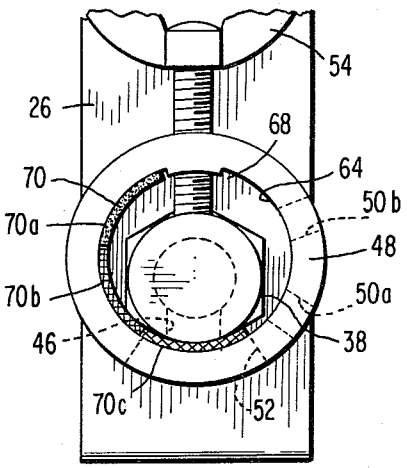
FIG. 6 is an end view of an alternate embodiment of the nozzle head assembly of FIGS. 2–5.

Turning now to FIG. 6, an alternate embodiment of the atomizing nozzle is disclosed. More specifically, the annular ring 48 is provided with a recessed area 68 along a substantial portion of the interior surface 64. The orifice ribbon 70 is extended and provided with three separate orifice zones 70*a*, 70*b*, and 70*c*, each of which may be selectively positioned between the radial bore 46 and the radial opening 52 of the annular ring 48. Each of the separate orifice zones includes orifices having a uniform diameter. However, the diameter of the orifice in adjacent orifice zones 70*a*, 70*b*, and 70*c* may be the same or different as desired.

In order to secure the separate ribbon zones in an operative position, the ring 48 is also fashioned with alternate internally threaded bores 50*a* and 50*b* for receiving wing nut 54.

The embodiment illustrated in FIG. 6 permits a rapid change of the orifice size and/or flow pattern when such a change is desirable. Moreover, if all orifices of the adjacent zones 70*a*, 70*b*, and 70*c* are identical, the embodiment may provide a rapid substitute to cleaning an orifice zone by merely shifting the ring 48.

Figure 7:
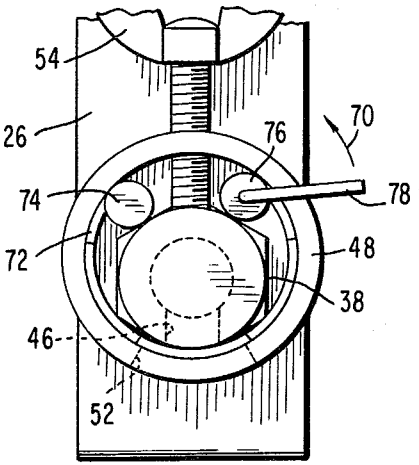
FIG. 7 is an end view of yet another embodiment of the nozzle head assembly of FIGS. 2–5.

Depicted in FIG. 7 is yet another embodiment which illustrates another variant of an orifice ribbon positioned between the nozzle body 38 and the annular ring 48. More specifically, a thin, flexible orifice ribbon 72 may be carried in a supply cartridge 74 and wound onto a takeup cartridge 76. The takeup cartridge 76 may be provided, for example, with an advancing lever 78 which is operable with a ratchet action in the direction illustrated by the arrow 80 to selectively advance the orifice ribbon 72.

The orifice ribbon 72 may also be provided with a plurality of orifice zones such as those illustrated in FIG. 6. With the embodiment of FIG. 7, however, it is anticipated that all orifices will be of the same diameter.

When it is desired to advance the orifice band 72 to expose the new orifice zone of the orifice band 72, the wing bolt 54 is slightly withdrawn to increase clearance between the nozzle body 38 and the annular ring 48. Then, the advancing lever 78 is rotated in the direction of the arrow 80 to position and index a new orifice zone in alignment between the radial opening 52 and the radial bore 46.

Returning to FIG. 1, the spray boom 14 is also illustrated with an alternate excitation arrangement comprising a magnetostrictive exciting assembly 82, similar to that discussed above. The exciting assembly 82, however, is connected directly to pipe 15 in order to induce longitudinal vibrations therein. This single unit is operably sufficient to serve all the branch conduits on at least half of the boom. With this embodiment, however, it may be desirable to use a longer magnetostrictive element than element 34.

By arranging the radial bore of nozzle assemblies 18 as noted above, excitation with the embodiment is still accomplished perpendicular to the flow of liquid through the nozzle apertures.

Operation

In operation, a suitable fluid is conveyed from tank 12 through pipe 15, branch conduits 16, and conduit members 20 to the generally cylindrical bore 48 of each nozzle body 38. The fluid leaves the cylindrical bore 48 by way of the radial bore 46 and passes through the orifices 60 of the orifice ribbon 58.

While liquid is passing through the nozzle assembly 18, the magnetostrictive device 34 is actuated to generate longitudinal oscillations in the conduit member 20 and the nozzle assembly 18 securely connected thereto. In this manner the orifice ribbon 58 is oscillated normal to the flow of liquid therethrough to induce the stream of fluid flowing through the orifices 60 to contract into fine uniformly sized droplets.

When it is desired to service or clean the nozzle assembly, the wing bolt 54 is simply withdrawn and the annular ring 48 removed from the nozzle assembly. Accordingly, the individual performing the cleaning operation may easily isolate his hands from contact with toxic liquids which may have been dispensed through the atomizing nozzle. Moreover, since the wing bolt 54 is diametrically opposite the radial bore 46, it is unlikely that the wing bolt 54 will have any toxic material thereon. With the annular ring 48 and orifice plate 54 removed, suitable cleaning fluid may be passed through the conduit member 20 to cleanse the internal surfaces thereof.

Should the apertures of orifice ribbon 58 become clogged at any time during the operation of the atomizing nozzle, either of the alternative embodiments depicted in FIGS. 6 and 7 further facilitate servicing by allowing a clean orifice zone of the orifice ribbon to be advanced into alignment with the radial bore and the radial opening.

While the nozzle above has been described in connection with the dispersal of liquid biological control agents, it should be noted that this invention is not limited to such an application. For example, it should be readily apparent that such a nozzle would be very effective in spray painting operations, chemical processes, etc.

SUMMARY OF MAJOR ADVANTAGES

In describing, in the foregoing, an atomizing method and apparatus according to preferred embodiments of the invention several advantages have been specifically and inherently disclosed. Nonetheless, a brief summary of major advantages at this point may be both useful and appropriate.

A principle advantage of the invention resides in the provision of the atomizing nozzle assembly which admits to facile servicing and/or cleaning in an "on the job/in the field" environment. Moreover, and in a similar manner, the subject atomizing nozzle assembly permits rapid changes in nozzle aperture sizes and/or flow patterns.

A related significant advantage is the ability to service, clean and/or change the subject atomizing apparatus without subjecting an operator to contamination by a liquid being atomized.

Further, it has been determined that external excitation of the nozzle assembly perpendicular to the flow of liquid through the ribbon orifice apertures enhances uniform droplet formation.

Additionally, external excitation of the nozzle assembly has been found to produce the desired results while minimizing sealing and flow difficulties. Moreover, in some instances, excitation of a spray boom, as opposed to individual nozzle assemblies, has produced acceptable results with a reduction in total power input.

A still further significant advantage is the provision of an atomizing, nozzle assembly which utilizes a thin sheet, flexible orifice ribbon which is relatively inexpensive to fabricate yet exhibit rugged wear characteristics.

In describing the invention, reference has been made to preferred embodiments. Those skilled in the art, however, and familiar with the disclosure of the invention may recognize additions, deletions, substitutions, or other modifications which would fall within the purview of the invention as defined in the claims.

What is claimed is:

1. A method for atomizing a liquid into droplets comprising the steps of:

fitting a thin, normally flat, flexible orifice ribbon means, having a plurality of apertures fashioned therethrough, across a radial aperture fashioned into a conduit adjacent a closed end thereof with the other end of the conduit being in communication with a source of liquid;

fitting a ring having a diameter greater than the diameter of the conduit around the closed end of the conduit;

operably aligning a radial port fashioned through the ring with the radial aperture extending into the conduit;

releasably securing the ring to the conduit wherein the central longitudinal axis of the ring is offset with respect to the central longitudinal axis of the conduit such that edge portions of the orifice ribbon are secured between the exterior surface of the conduit and the interior surface of the ring;

pressuring the liquid within the conduit for issuing streams of liquid through the apertures within the flexible orifice ribbon.

2. A method for atomizing a liquid into droplets as defined in claim 1 wherein:

said thin, normally flat, flexible orifice ribbon is fashioned with a plurality of longitudinally spaced orifice zones, said method further including the steps of:

releasing the ring means from securely connecting the orifice ribbon to the exterior surface of the conduit means, longitudinally advancing the ribbon such that a new set of orifices are brought into operative registry with the radial aperture extending through the conduit means, and resecuring the ring to the conduit whereby the orifice ribbon is again secured between the exterior surface of the conduit and the interior surface of the ring.

3. A nozzle apparatus for atomizing a liquid into droplets comprising:

conduit means having one end closed and the other end thereof in communication with a fluid under pressure, said conduit means having a generally unobstructed interior bore and a radial aperture extending through a wall of said conduit means in a position adjacent said closed end thereof;

ring means connected to said conduit means generally adjacent said closed end of said conduit means, said ring means having a diameter greater than the diameter of said conduit means, said ring means further being fashioned with a radial port operably alignable and dimensionally compatible with said radial aperture in said conduit means;

a thin, normally flat, flexible, orifice ribbon means having a plurality of apertures fashioned therethrough, said orifice ribbon being releasably intercalated between the exterior surface of said conduit means and the interior surface of said ring means in a posture extending across said radial aperture in said conduit means and said radial port in said ring means, and attachment means connected to said ring means for releasably securing said ring means to said conduit means wherein the central longitudinally extending axis of said ring means is offset with respect to the central longitudinal axis of said conduit means such that edge portions of said ribbon means are secured between the interior surface of said ring means and the exterior surface of said conduit means with said ribbon means flexing into an arcuate configuration compatible with the exterior surface of said conduit means.

4. The nozzle apparatus for atomizing a liquid into droplets as defined in claim 3 wherein:

said orifice ribbon includes a plurality of orifice zones said zones being spaced upon said ribbon such that only one orifice zone is alignable with said radial aperture in said conduit means at any one time.

5. The nozzle apparatus for atomizing a liquid into droplets as defined in claim 4 and further comprising:

advancement means for selectively advancing said orifice ribbon to position a sequential orifice zone over said radial aperture of said conduit means.

6. The nozzle apparatus for atomizing a liquid into droplets as defined in claim 3 wherein:

said attachment means comprises a threaded fastener, carried by said ring means in a posture generally radially extending with respect thereto, and being operable to engage the exterior surface of said conduit means in a position diametrically opposite to said radial aperture.

* * * * *